US005380482A

United States Patent [19]

Maginnis et al.

[11] Patent Number: 5,380,482

[45] Date of Patent: Jan. 10, 1995

[54] METHOD OF MANUFACTURING INGOTS FOR USE IN MAKING OBJECTS HAVING HIGH HEAT, THERMAL SHOCK, CORROSION AND WEAR RESISTANCE

[75] Inventors: David B. Maginnis, Norman; Frank Maginnis, Moore, both of Okla.

[73] Assignee: Aspen Research, Inc., Moore, Okla.

[21] Appl. No.: 43,628

[22] Filed: Apr. 2, 1993

Related U.S. Application Data

[63] Continuation-in-part of Ser. No. 780,703, Oct. 18, 1991, abandoned.

[51] Int. Cl.[6] ..... B22F 3/14; B22F 1/00

[52] U.S. Cl. ..... 419/33; 419/48; 419/52; 419/44; 419/47; 419/57; 75/255; 75/252; 75/253

[58] Field of Search ..... 419/32, 38, 39, 48, 419/57, 20, 25, 12, 33, 52, 44, 47; 75/235, 244, 249, 254, 255, 252

[56] References Cited

U.S. PATENT DOCUMENTS

| | | | |
|---|---|---|---|
| 2,915,801 | 12/1959 | Harry | 75/27 |
| 3,248,215 | 4/1966 | Bonis et al. | 75/226 |
| 3,311,522 | 3/1967 | Ladd et al. | 156/206 |
| 3,413,392 | 11/1968 | Meadows | 264/102 |
| 3,591,362 | 7/1971 | Benjamin | 419/244 |
| 3,660,049 | 5/1972 | Benjamin | 29/182.5 |
| 4,325,734 | 4/1982 | Burrage et al. | 75/225 |
| 4,612,165 | 9/1986 | Liu et al. | 420/459 |
| 4,711,761 | 12/1987 | Liu et al. | 420/459 |
| 4,722,828 | 2/1988 | Liu | 420/455 |
| 4,731,221 | 3/1988 | Liu | 420/445 |
| 4,747,990 | 5/1988 | Gaussens et al. | 264/322 |
| 4,801,415 | 1/1989 | Hughes | 264/120 |
| 4,894,086 | 1/1990 | Huether et al. | 75/0.5 A |
| 4,909,842 | 3/1990 | Dunmead et al. | 75/236 |
| 4,911,762 | 3/1990 | Steinemann | 148/2 |
| 4,946,643 | 8/1990 | Dunmead et al. | 419/12 |
| 4,961,903 | 10/1990 | McKamey et al. | 420/79 |
| 5,098,469 | 3/1992 | Rezhets | 75/249 |

*Primary Examiner*—Donald P. Walsh

*Attorney, Agent, or Firm*—Watson, Cole, Grindle & Watson

[57] ABSTRACT

A method of manufacturing ingots for use in making objects having heat, thermal shock, corrosion and wear resistance by formulating a composition of about 17–80% $TiB_2$ powder, about 0.0 to 4.0% $Y_2O_3$ powder, and the balance of NiAl powder, the powders being thoroughly admixed, and placing the admixture into a mold in which it is subjected to a pressure of about 7000 psi and a temperature of about 1400° C. for 20 to 140 minutes in an inert atmosphere, after which the mold is cooled and the ingot is removed and ready for use in manufacturing an object. In some applications the use of a ceramic filler material mixed with the powder is employed to improve the physical characteristics of the finished ingot.

22 Claims, 1 Drawing Sheet

METHOD OF MANUFACTURING INGOTS FOR USE IN MAKING OBJECTS HAVING HIGH HEAT, THERMAL SHOCK, CORROSION AND WEAR RESISTANCE

CROSS REFERENCE TO RELATED APPLICATIONS

This is a continuation-in-part of application Ser. No. 07/780,703 filed Oct. 18, 1991, now abandoned.

BACKGROUND OF THE DISCLOSURE

This invention relates to a composition for use in manufacturing ingots from which parts can be made having heat, thermal shock, corrosion and wear resistance. The method and composition herein is particularly used in manufacturing plungers for use in the glass container manufacturing industry.

Because of thermal shock, wear, and scratches due to particulate contamination in molten glass, there is an increased interest in development of strong, heat resistant, thermal shock, corrosion, and wear resistant material for use in manufacturing plungers as substitutes for cobalt, nickel cast alloys and stainless steel parts presently used in the glass industry. It has been discovered that nickel aluminide, NiAl, composites have good applicability for this purpose because of their high melting temperatures, hardness, and corrosion resistance.

Nickel aluminide has many different stoichiometric compounds. These compounds have significantly different properties. $Ni_3Al$ with small amounts of boron, or hafnium, or zirconium is disclosed in U.S. Pat. No. 4,612,165. The material was investigated for the U.S. Department of Energy as a substitute for stainless steel. It can be cast into ingots, cold rolled and fabricated into many shapes.

The nickel aluminide used in this disclosure, that is, NiAl, has a much higher melting temperature and is harder than $Ni_3Al$ but it cannot be cast and still retain its stoichiometric compound. When it is cast the nickel aluminide undergoes a phase separation into nickel and aluminum. This effect can be recognized when studying the phase diagrams in Vol. 8, pp. 262, Eighth Edition of "The American Society For Metals, Metal Handbook". When phase separation takes place the alloy's melting temperature drops significantly and it loses some of its corrosion resistances.

Although several alloy compounds of nickel aluminide exist, NiAl has the favorable characteristic of a high melting temperature, that is, 1640° C. It has been discovered that a composite formed of NiAl and titanium diboride has unexpected levels of hardness and decreased wear rates. The composite formed of NiAl and $TiB_2$ is characterized by its high temperature properties, high hardness and its lack of depressing the melting point of NiAl.

The NiAl composites of this disclosure are excellent engineering materials and it is expected that they will find many other uses in fabrication of components for turbines, pumps, wear seals, wear plates, foundry tools and other equipment or tools that are exposed to severe wear, thermal shock, and/or high temperatures. The addition of certain platelets, ceramic whiskers or fibers serve to increase the high temperature strength.

For information relating to other compositions having charactistics of hardness of high temperatures and thermal shock and corrosion resistance, see the following U.S. Pat. Nos. 2,915,801; 3,248,215; 3,311,522; 3,413,392; 4,325,734; 4,382,053; 4,612,165; 4,711,761; 4,722,828; 4,731,221, 4,747,990; 4,801,415 and 4,961,903.

SUMMARY OF THE INVENTION

A method of manufacturing ingots for use in making objects having heat, thermal shock, corrosion and wear resistance is accomplished by providing the materials and the process of forming ingots having these characteristics, the ingots being thereby useable for manufacturing parts. A composition is formed for use in forming ingots of this type, the composition containing about 17 to 80% $TiB_2$ powder, 0.0 to 4.0% $Y_2O_3$ powder and the balance of NiAl powder. The powders being thoroughly admixed. In the preparation of the composition the powders are preferably admixed in a ball mill for a long period, that is, for about 10 to 48 hours to reduce the powder size to a very fine grain.

The composition can be improved for certain applications, particularly wherein thermal and physical shock are important, by the incorporation of ceramic reinforcing components in the form of particulate, platelets, fibers or whiskers made of $TiB_2$, $Al_2O_3$, $B_4C$, TiC, and SiC and mixtures thereof.

In another embodiment of the present invention, $CrB_2$ powder is admixed with NiAl powder to form a composition for use in making ingots. The addition of $CrB_2$ to the aforementioned mixture of $TiB_2$ and NiAl also provides a composition which can be used to form an ingot having excellent thermal shock properties and which resists reaction with molten glass at 2100° F.

The method of manufacturing an ingot includes milling the powder as above stated and placing the composition in a mold. The powder in the mold is then subjected to high pressure and temperature for a time to cause the admixture to fuse into a high density ingot. It has been learned that the desired pressure is about 7000 psi and the desired temperature is about 1400° C., the pressure and temperature of the admixture being maintained for about 20 to 140 minutes. Thereafter the mold is allowed to cool and the ingot removed. The ingot may then be used in manufacturing a product for use in industry, such as a plunger for use in the glass making industry.

When an object is needed having a blind opening therein it can be manufactured from an ingot formed in a mold in which the mold includes a floating cylinder, the cylinder forming the blind opening in the completed ingot.

A better understanding of the invention will be had by reference to the following description of the preferred embodiment and the claims, taken in conjuction with the attached drawing.

DESCRIPTION OF THE PREFERRED EMBODIMENT

Figure 4:
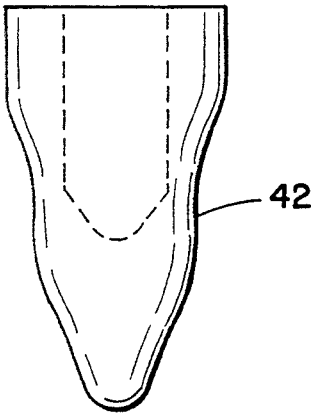
FIG. 4 is an isometric view of a component manufactured according to the principles of this disclosure, such as from the ingot of FIG. 3, that is, a plunger useable in the glass container manufacturing industry.

The first step in manufacturing an object having heat, thermal shock, corrosion and wear resistance is to formulate a composition. This is achieved by thouroughly admixing powder components, such as in a grinding operation and more particularly such as in a ball milling machine. The powder compositions are formed of NiAl powder admixed with at least one of $CrB_2$ powder and $TiB_2$ powder. Optionally, a small amount of $Y_2O_3$ powder may be added to any of the compositions as a sintering aid to assist in compaction of the powder mixture at high temperature. A small amount of elemental nickel may also be optionally added to act as a glue to hold the different powders together.

Up to five percent of the total powder mixture may comprise elemental nickel. If higher percentages are of elemental nickel are used it softens the resulting ingot formed upon hot pressing. About three percent by weight elemental nickel is preferably used based on the weight of $CrB_2$ used. If $CrB_2$ is a component of the powder mixture, the elemental nickel is preferably premixed with the $CrB_2$ before mixing with the other powders. Whether or not $CrB_2$ is used in a powder mixture, elemental nickel is preferably added in an amount of less than five percent by weight with the range of from one to five percent by weight being preferred.

Like any of the powders used in the compositions of the present invention, the elemental nickel is preferably ball milled to a size of between one and two microns prior to mixing with other powders and hot pressing. Usually, ball milling for a period of between about 1 and 48 is sufficient to form a uniform mixture having an average particle size of between one and two microns and very little deviation in size.

In a broad sense, the present invention relates to a composition comprising: (1) at least one member selected from the group consisting of (a) and (b), wherein (a) is about 10 to about 90 percent by weight $CrB_2$ powder and (b) is about 10 to about 80 percent by weight $TiB_2$ powder; (2) up to about five percent by weight powdered elemental nickel; (3) up to about four percent by weight $Y_2O_3$ powder; and (4) NiAl powder present in an amount of up to about 90 percent by weight, wherein the powders are thoroughly admixed.

One preferred powder composition according to the present invention comprises between about 20 percent by weight and about 90 percent by weight $CrB_2$ powder, up to about five percent by weight metallic or elemental nickel, up to about four percent by weight $Y_2O_3$ and the balance NiAl powder. Another powder composition according to the present invention comprises up to about 60 percent by weight $CrB_2$ powder, between about 10 and about 60 percent by weight $TiB_2$ powder, up to about four percent by weight $Y_2O_3$, up to about five percent by weight elemental nickel, and the balance being NiAl powder. Yet another composition of the present invention comprises 17–80 percent by weight $TiB_2$ powder, up to four percent by weight $Y_2O_3$ and the balance NiAl powder. Compositions consisting essentially of these powder mixtures and consisting only of these powder mixtures are also preferred.

When the powder compositions are used in a process according to the present invention, an ingot is formed by hot pressing. An object formed from the ingot exhibits excellent heat, thermal shock, corrosion and wear resistant characteristics.

The exact amount of each powder to be used in a mixture depends upon the desired hardness and application of a formed ingot. For instance, if an ingot is to machined into a tool for use in a wire drawing process, it is preferred that the tool exhibit a Rockwell C hardness of between about 60 and 62. These tools include reducing rolls, push rolls, pulling rolls, guide spools and swedging dies. Together, these tools are used to reduce copper and other metal ingots into wire form. Steel, platinum and tungsten can also be drawn into wire form by using such tools. Not only is it important that the tools exhibit a Rockwell C hardness of between 60 and 62, but they must also be able to work metals at very high temperature. For example, copper ingots are drawn into wire form while at a temperature of about 1900° F.

To achieve the desired hardness and high temperature resistance, a composition is used comprising between 30 and 50 percent by weight $CrB_2$, up to five percent by weight elemental nickel, up to four percent by weight $Y_2O_3$ and the balance NiAl powder. It has been found that compositions containing over 50 percent by weight $CrB_2$ have too high a hardness for this application. Similar compositions having a $CrB_2$ content of between about 38 and 42 percent by weight are even more preferred for wire drawing tool applications.

Ingots made from the compositions of the present invention can also be used to make tool insert blanks having a Rockwell C hardness of between about 70 and 75. To achieve this high hardness, a composition having an even higher amount of $CrB_2$, compared to the compositions used for wire drawing tools, is hot pressed to form an ingot. The composition for forming a tool insert blank comprises between about 60 and 80 present by weight $CrB_2$, up to five percent by weight elemental nickel, up to four percent by weight $Y_2O_3$ and the balance NiAl powder. More preferably, the composition comprises between 68 and 74 percent by weight $CrB_2$ with an amount of about 70 percent by weight being even more preferred.

For applications where the composition is to formed into a plunger used to form bottles from molten glass, it is desirable that a formed ingot exhibit excellent heat, thermal shock, corrosion and wear resistance. The plunger must have a high hardness and resist scratching caused by impurities in the molten glass. The plunger must also not react with molten glass.

To achieve these properties, an ingot formed from a composition according to the present invention is provided which can be machined into a plunger having a Rockwell C hardness of about 70. The composition preferably contains between about 10 and about 40 percent by weight $TiB_2$ which enhances the heat and thermal shock resistance of a formed ingot. The composition preferably comprises up to about 80 percent by weight $CrB_2$, between about 10 and about 40 percent by weight $TiB_2$, up to five percent by weight elemental nickel, up to four percent by weight $Y_2O_3$, and the balance NiAl powder. More preferably, the composition comprises between about 30 and 60 percent by weight $CrB_2$, between about 20 and about 30 percent by weight $TiB_2$, up to five percent by weight elemental nickel, up to four percent by weight $Y_2O_3$, and the balance NiAl powder. In each of the compositions, it is preferred that at least about 10 percent by weight NiAl be included. One preferred composition comprises about 60 percent by weight $CrB_2$, about 10 percent by weight $TiB_2$, about one percent by weight elemental nickel, up to four percent by weight $Y_2O_3$, and the balance NiAl powder.

Any of the compositions used for the applications discussed above may be reinforced with ceramic particulates, fibers or whiskers. Preferred ceramic particulates, fibers or whiskers which are used as reinforcing structures include ceramics such as $TiB_2$, $Al_2O_3$, $B_4C$, TiC and SiC. If used, the reinforcing ceramic particles, whiskers or fibers are preferably added in an amount of up to about 50 percent by weight based on the total weight of the powder composition. For tool blank inserts, compositions reinforced with SiC whiskers are particularly preferred.

In one test of the composition a mixture of 55.3% nickel aluminide (NiAl) powder, 42.7% titanium diboride ($TiB_2$) powder and 2% by total weight of yttria oxide ($Y_2O_3$) powder was ball milled 12 hours in a zirconia grinding media. Ball milling was used for mixing the powders and reducing particle size. The powder mixture was then separated from the grinding media by using sieves and a shaker. An ingot was obtained by pouring a measured amount of powder into a graphite mold assembly for hot, high temperature pressing.

Figure 1:
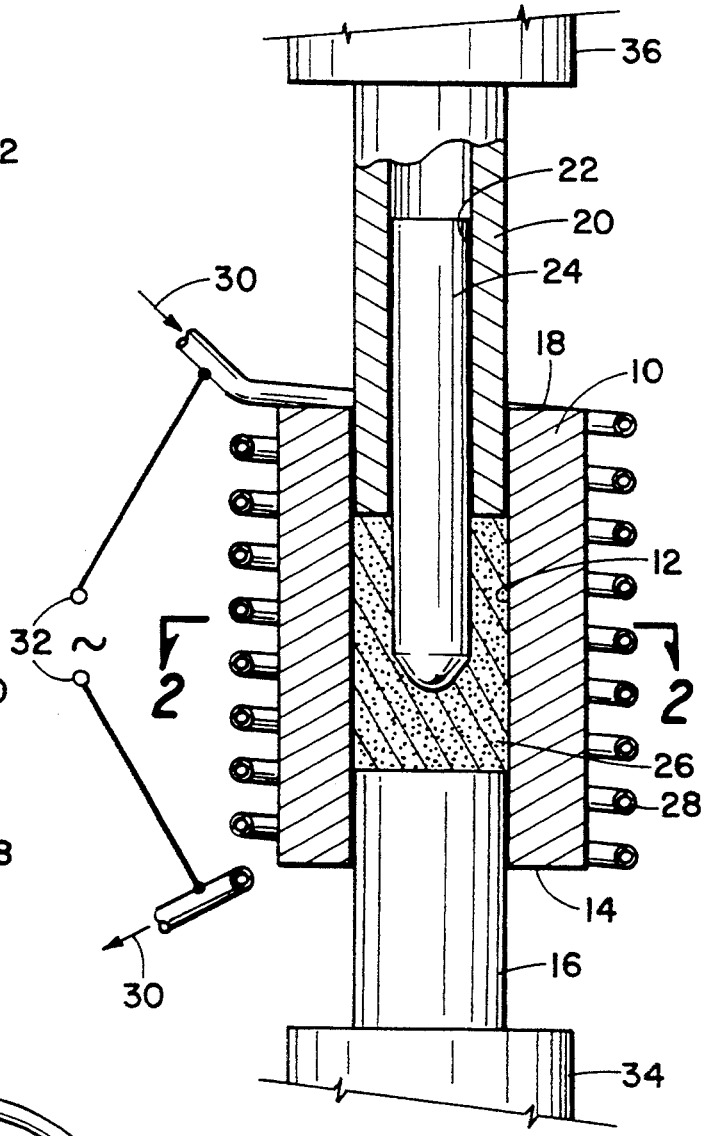
FIG. 1 is an elevational partial cross-sectional view of a mold used in the process of applying pressure and heat to an admixture of selected powdered ingredients to form an ingot for use in manufacturing an article.
Figure 2:
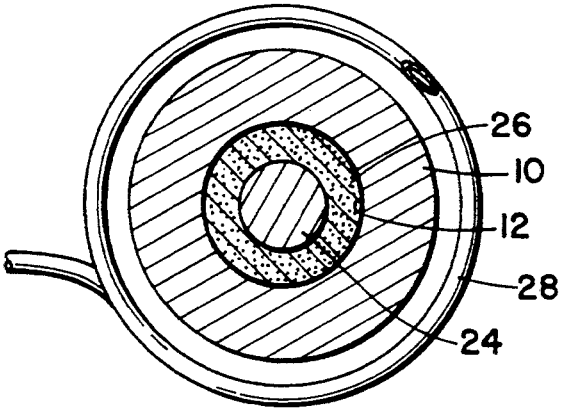
FIG. 2 is a cross-sectional view of the center portion of the mold of FIG. 1 taken along the line of 2—2 of FIG. 1.

The ingot was manufactured utilizing the processes shown in FIGS. 1–2. A tubular die body 10 has a central opening 12 therethrough. The die body is preferably formed of a conductive graphite material. Received within a first end 14 of the die body is a plug cylinder 16 which may be made of carbon or low conductive graphite.

Received in the second end 18 of the die body 10 is a tubular piston member 20 having a central opening 22 therein. The tubular piston member 20 is, like the plug cylinder 16, preferably formed of carbon or low conductive graphite.

Telescopically received within central opening 22 in the tubular piston member 20 is a floating cylinder 24 that may be formed of carbon or low conductive graphite.

The powder composition 26, as previously described, is placed within the die body central opening 12 between plug cylinder 16 and tubular piston member 20. The floating cylinder 24 is positioned at its selected depth within the powder.

Surrounding the die body 10 is an inductive coil 28 that preferably is formed of tubular copper to permit the circulation of cooling fluid therethrough as indicated by the arrows 30. An alternating current voltage source is applied at 32 to heat the die body and the powder composition 26 by induction.

Pressure is applied to the powder 26 by rams 34 and 36 although, of course, one of these can be stationary. High pressure is required on powder 26 during the fusion process and in the preferred arrangement, the pressure is applied at about 7000 psi. At the same time, AC energy is applied to the inductive coil 28 to heat the powder 26 to a temperature of about 1400 degrees C. This pressure at this temperature is maintained for about 20 to 140 minutes to fuse the powder into a solidified ingot.

After the pressure and heating steps, die body 10 is allowed to cool and the ingot removed. The ingot 38 of FIG. 3 has an opening 40 therein conforming to the portion of floating cylinder 24 extending beyond the end of the tubular piston member 20 during the manufacturing process.

The process of FIGS. 1 and 2 is shown more or less diagrammatically. The die body is preferably continually surrounded by an inert gas during the manufacturing processes and the use of carbon felts and alumina furnace boards can be employed to enclose the die body and the other components during the pressure and heating stages of the manufacturing process.

Figure 3:
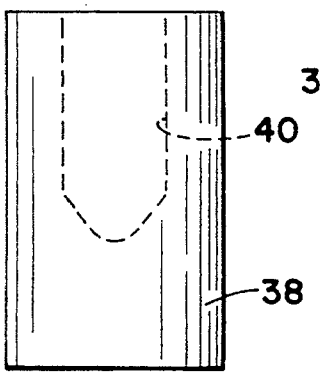
FIG. 3 is an elevational view of an ingot manufactured according to the apparatus shown in FIGS. 1 and 2 ready for use in manufacturing a component.

The ingot 38 of FIG. 3 can be used to manufacture a finished product by machining the ingot into the desired configuration. FIG. 4 illustrates a plunger 42 useable in the glass container manufacturing industry of the type that can be made out of ingot 38. The external shape of ingot 38 can be varied according to the configuration of the die body plug cylinder 16 and the tubular piston member 20 and floating piston 24 employed in the ingot manufacturing process. The configuration of opening 40 can be varied according to the shape of floating cylinder 24.

EXAMPLE 1

A series of test specimens were made by the process described above except the following. A mixture (hereinafter referred to as #1 mix) was made of 490 grams of HCST Corp Amperit 290.3 NiAl powder 69-31, spec. −45+5.6, was ball milled with 10 grams of yttrium oxide ($Y_2O_3$) powder grade 5600, 99.99%, from MOLYCORP, INC. for 24 hours. Then a 10% titanium dibordide sample was made by adding 10 grams $TiB_2$, made by UNION CARBIDE grade HCT-F, to 90 grams of #1 mix plus 0.20 gram $Y_2O_3$. This mixture was then ball milled for 12 hours. A similar process was used for 20% through 90% $TiB_2$ samples, where the 90% $TiB_2$ had 1.8 grams of $Y_2O_3$.

The material properties are shown in Table I. Sample preparation was accomplished by standard metallurgical polishing procedures. Hardness was measured with a Wilson Tucan Microhardness instrument with a 10 kilogram load and a Vickers diamond pyramid indenter, 136° angle. The filar readings were made at 200× and converted to Rockwell "C" scale by chart.

Shown in Table I, the specimens were harder with increasing % of titanium diboride up to 80%, after which it decreases. The sudden drop in hardness at 90% $TiB_2$ was the result of insufficient matrix to hold the $TiB_2$ together. Extensive amount of porosity was observed at the 90 and 100% loads. The 100% $TiB_2$ can be made significantly harder by hot pressing at much higher temperatures and pressures.

EXAMPLE II

Test specimens were made and processed as described in Example I, except that titanium diboride was kept at 40% and $Y_2O_3$ was varied by 1%, 1.3%, 2%, 3.39%, 4.7% and 6.7%. The rate of increase in hardness was maximum at approximately 2% of $Y_2O_3$.

TABLE I

| % #1 Mix* | % OF $TiB_2$ | HARDNESS R"C" |
|---|---|---|
| 100 | 0 | 30–34.0 |
| 85 | 15 | 52.7 |
| 83 | 17 | 59.8 |
| 75 | 25 | 61.7 |
| 60 | 40 | 66.0 |
| 50 | 50 | 68.0 |
| 40 | 60 | 69.3 |
| 30 | 70 | 70.6 |
| 20 | 80 | 71.0 |
| 10 | 90 | 53.0 |

TABLE I-continued

| % #1 Mix* | % OF $TiB_2$ | HARDNESS R"C" |
|---|---|---|
| 0 | 100 | 54.0 |

Table I was compiled from 4 test runs with hot pressing times varying from 30 to 60 minutes at 7000 +/− 200 psi and temperature at 1400 +/− 10°.
*#1 mix = 98% NiAl + 2% $Y_2O_3$ by weight
NiAl = 69.2% Ni + 30.8% Al

TABLE II

| % #1 MIX* | % OF $TiB_2$ | HARDNESS R"C" |
|---|---|---|
| 90 | 10 | 59.2 |
| 50 | 50 | 70.5 |
| 40 | 60 | 73.5 |
| 30 | 70 | 74.5 |
| 20 | 80 | 48.6 |
| 10 | 90 | 54.9 |

Table II was compiled from 1 test run with hot pressing time at 45 minutes at 7000 psi and temperature at 1400 +/− 10°.
*#1 mix = 98% NiAl + 2% $Y_2O_3$ by weight
NiAl = 69.2% Ni + 30.8% Al The addition of $CrB_2$ to the mixture of $TiB_2$, $Y_2O_3$ and NiAl significantly enhances the hardness of a formed ingot. Depending on the desired application and hardness of an ingot formed from the powder mixture, the amount of $CrB_2$ added to the first admixture may vary as discussed above. The present invention contemplates the use of $CrB_2$ added in an amount of up to 80 percent by weight.

Compositions comprising a 1:1:1 ratio of $CRB_2$, $TiB_2$ and NiAl and a small amount of $Y_2O_3$ and/or elemental nickel have provided ingots having Rockwell C hardness measurements of greater than 70, as shown below in Table IV. High hardness values and other desirable properties are also exhibited by ingots made from compositions of the present invention comprising 25 percent by weight $TiB_2$, 35 percent by weight $CrB_2$, 33 percent by weight NiAl, two percent by weight $Y_2O_3$, and five percent by weight elemental nickel.

Table III below shows the data obtained during a hot press run of various compositions. Example 4 in the table shows the results of experiments done on compositions comprising 41 percent by weight NiAl powder, 29.4 percent by weight $TiB_2$ and 29.4 percent $CrB_2$ powder. The results indicate that ingots formed from the composition of Example 4 can be used to form objects which have excellent properties for molten glass plunger applications.

Table III shows the time, temperature, relative percentage of kilowatts (KW), the pressure exerted on the composition (Psig), the displacement of a ram measured in inches, and a dial indicator reading used to determine when the ram has almost stopped moving or other notes.

The temperature readings in Table III are taken from a thermal couple disposed three inches deep in the wall of the die jacket. To determine the pounds per square inch that the sample powder is subjected to, the measured Psig is multiplied by the area of the ram in square inches (12.56) divided by the area of the inside of the die jacket (1.44 square inches). Thus, a sample subjected to 720 Psig is subjected to 6280 Psi.

After the samples are hot pressed into an ingot, they are removed from the die and sand-blasted to be cleaned. The cleaned ingot is then polished on a LECO unit, for example, model #VP-150 Vari-Pol by Leco Corp., St. Joseph, Mich. Samples are then tested for hardness and grain boundary appearance to estimate fracture toughness.

TABLE III

| Ex. No. | Mixture | Time | Temp (°C.) | % KW | Psig | Displacement | Notes |
|---|---|---|---|---|---|---|---|
| III | 50% $CrB_2$<br>50% NiAl | 10 mins. | 1300–1359 | 60–40 | 480–600 | 9 5/16–9 3/16 | 4361 psi |
| IV | 29.4% $TiB_2$<br>29.4% $CrB_2$<br>41% NiAl | 29 mins. | 1415–1432 | 40–40 | 650–700 | 9⅛–9 | |
| V | 33.3% $TiB_2$<br>33.3% $CrB_2$<br>33.3% NiAl | 50 mins. | 1440–1480 | 40–30 | 820–825 | 9⅜–9¼ | |
| VI | 33.3% $TiB_2$<br>33.3% $CrB_2$<br>33.3% NiAl | 50 mins. | 1448–1455 | 30–33 | 825–815 | 9¼–9⅛ | |

Hardness is tested to determine (1) a Filar reading from a TUKON® microhardness tester (available from Wilson® Instruments, Binghamton, N.Y.), (2) a 136° diamond pyramid hardness number, and (3) the Rockwell hardness number. Table IV below, shows the hardness measurements of numerous samples. It is clear that the 50:50 mixture of $CrB_2$ and NiAl can be hot pressed into an ingot having excellent hardness.

TABLE IV

| Ex. No. | Mixture | Filar Reading | 136° Diamond Pyramid Hardness # | Rockwell Hardness # |
|---|---|---|---|---|
| III | 50% $CrB_2$<br>50% NiAl | 251 | 1175 | 71.5 |
| IV | 29.4% $TiB_2$<br>29.4% $CrB_2$<br>41% NiAl | 214 | 1610 | 76.7 |
| V | 33.3% $TiB_2$<br>33.3% $CrB_2$<br>33.3% NiAl | 248 | 1205 | 71.5 |
| VI | 33.3% $TiB_2$<br>33.3% $CrB_2$<br>33.3% NiAl | 254 | 1150 | 70.8 |

In the preparation of the compositions according to the present invention, various organic binders and/or pelletizing agents may be used as grinding aids or for pelletizing. Pelletizing primarily changes the powder from dust to a material that can be poured into die cavities. Binders and pelletizers which may be used include methanol, starch, corn starch, methylcellulose (e.g. Methocel, available from Dow Chemical, Midland, Mich.,) polyvinyl alcohol, numerous fatty acids. One of the more preferred binders is polyvinyl alcohol (PVA). The organic binders burn-off at or before a temperature of 365° C. is reached, leaving no ash or an insignificant amount of an ash residue.

If alcohol is used for a pelletizing agent, the amount of alcohol which may be used is up to about 25 percent by weight based on the total weight of the powder composition.

The above examples illustrate that the mixtures of powders according to the present invention enable the formation of an ingot which be used to form an object having excellent heat, thermal shock, corrosion and wear resistance.

The claims and the specification described the invention presented and the terms that are employed in the claims draw their meaning from the use of such terms in the specification. The same terms employed in the prior art may be broader in meaning than specifically employed herein. Whenever there is a question between the broader definition of such terms used in the prior are and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of manufacturing an ingot for use in making an object having heat, thermal shock, corrosion and wear resistant characteristics comprising:

combining about 17–80% $Ti_1B_2$ powder, about 0.0–4.0% $Y_2O_3$ powder and the balance of NiAl powder to form a mixture;

milling the mixture for about 10 to 48 hours to form a finely admixed composition;

placing the composition in a mold;

subjecting the composition in the mold to high pressure and temperature for a time to cause the composition to fuse into a high hardness ingot; and cooling the ingot and removing it from the mold.

2. The method of manufacturing an ingot according to claim 1 wherein said composition in said mold is subjected to a pressure of about 7000 psi and a temperature of about 1400° C.

3. The method of manufacturing an ingot according to claim 2 in which such heat and pressure is applied for about 20 to 140 minutes.

4. The method of manufacturing an ingot according to claim 1 wherein said mold is encompassed in an inert atmosphere during the application of heat and pressure.

5. The method of manufacturing an ingot according to claim 1 wherein the mold in which said composition is placed is formed at least in part by a tubular die body of conductive graphite and wherein high temperature is applied to said composition by an inductance coil surrounding said tubular die body.

6. The method of manufacturing an ingot according to claim 5 wherein the mold in which said composition is placed is formed in part by said tubular die body having opposed open ends, a cylindrical plug member extending within one said end of tubular die body, a tubular piston member extending telescopically within the other said end of said tubular die body and a floating cylinder member telescopically received in said tubular piston member, said composition being received within said tubular die body between said plug member and said piston members, said floating cylinder member extending beyond tubular piston member into the composition, the ingot being formed in part around said floating cylinder member.

7. A composition comprising:

about 17–80% $TiB_2$ powder, about 0.0–4.0% $Y_2O_3$ powder, and the balance NiAl powder, the powders being thoroughly admixed by ball milling for a period of about 10 to 48 hours.

8. A composition according to claim 7 including the addition of a ceramic reinforcing components selected from the group comprising, $TiB_2$, $AL_2O_{O3}$,$B_4C$, TiC, and SiC and mixtures thereof, such reinforcing component being in the form of platelets, particulate, fibers or whiskers.

9. A powder composition comprising:

at least one member selected from the group consisting of (a) and (b), wherein (a) is about 10 to about 90 percent by weight $CrB_2$ powder and (b) is about 10 to about 80 percent by weight $TiB_2$ powder;

up to about five percent by weight powdered elemental nickel;

up to about four percent by weight $Y_2O_3$ powder; and

NiAl powder present in an amount of up to about 90 percent by weight, wherein said powders are thoroughly admixed.

10. The composition according to claim 9, comprising between about 10 and about 80 percent by weight $CrB_2$ powder, and between about 10 and 40 percent by weight $TiB_2$ powder.

11. The composition as in claim 9, comprising between about 30 and about 60 percent by weight $CrB_2$ powder and between about 20 and 30 percent $TiB_2$ powder.

12. The composition according to claim 9, comprising between about 20 and about 90 percent by weight $CrB_2$ powder, up to five percent by weight elemental nickel, up to four percent by weight $Y_2O_3$ powder and the balance NiAl powder.

13. The composition according to claim 12, comprising between about 60 and 80 percent by weight $CrB_2$ powder.

14. The composition according to claim 9, comprising between about 30 and about 50 percent by weight $CrB_2$ powder, up to five percent by weight elemental nickel, up to four percent by weight $Y_2O_3$ powder and between about 41 and 70 percent by weight NiAl powder.

15. A composition comprising according to claim 11, further comprising reinforcing ceramic particles, whiskers or fibers selected from the group consisting of $TiB_2$, $Al_2O_3$, $B_4C$, TiC and SiC, said reinforcing ceramic particles, whiskers or fibers being added in an amount of up to about 50 percent by weight based on the total weight of the powder composition.

16. A composition according to claim 9, comprising elemental nickel present in an amount of up to about 5.0 percent by weight.

17. The composition according to claim 11, wherein said powders are thoroughly admixed by ball milling for a period of between about 10 to 48 hours.

18. A method of manufacturing an ingot for use in making an object having heat, thermal shock, corrosion and wear resistant characteristics, said method comprising the steps of:

combining at least one member selected from the group consisting of (a) and (b), wherein (a) is about 10 to about 90 percent by weight $CrB_2$ powder and (b) is about 10 to about 80 percent by weight $TiB_2$ powder, with up to about five percent by weight powdered elemental nickel, with up to about four percent by weight $Y_2O_3$ powder, and with NiAl powder in an amount of up to about 90 percent by weight, to form a powder mixture;

milling the powder mixture for about 1 to 48 hours to form a finely admixed composition;

placing the composition in a mold;

subjecting the composition in the mold to high pressure and temperature for a time to cause the composition to fuse into a high hardness ingot; and cooling the ingot and removing it from the mold.

19. A method according to claim 18, further comprising the step of mixing said finely admixed composition with an organic binder or pelletizing agent prior to placing the composition in the mold.

20. A method according to claim 18, wherein said step of combining comprises combining between about 10 and about 80 percent by weight $CrB_2$ powder with about 10 to about 40 percent by weight $TiB_2$ powder and with NiAl powder present in an amount of up to about 80 percent by weight to form a mixture.

21. A method according to claim 18, wherein said step of combining comprises combining about 60 and 80 percent by weight $CrB_2$ powder with about with up to about five percent by weight powdered elemental nickel, with up to about four percent by weight $Y_2O_3$ powder, and the balance NiAl powder to form a powder mixture.

22. An ingot made by the process according to claim 18.

* * * * *